United States Patent [19]

Neil

[11] 4,025,980

[45] May 31, 1977

[54] SECTIONAL PAINT BRUSH

[76] Inventor: Thomas J. Neil, 14 Everett St., Dorchester, Mass. 02122

[22] Filed: May 24, 1976

[21] Appl. No.: 689,258

[52] U.S. Cl. ..... 15/202; 248/110

[51] Int. Cl.[2] ..... A46B 7/04

[58] Field of Search ..... 15/202, 145, 176, 194, 15/246; 248/110

[56] References Cited

UNITED STATES PATENTS

| | | | |
|---|---|---|---|
| 2,629,125 | 2/1953 | Ferguson | 15/202 |
| 2,677,841 | 5/1954 | Tetzlaff | 15/202 |
| 2,712,145 | 7/1955 | Karnes | 15/202 |
| 2,787,016 | 4/1957 | Carpenter | 15/202 |

FOREIGN PATENTS OR APPLICATIONS

| | | | |
|---|---|---|---|
| 533,116 | 11/1954 | Belgium | 15/246 |
| 809,485 | 7/1951 | Germany | 15/202 |
| 4,941 | 3/1890 | United Kingdom | 15/145 |

*Primary Examiner*—Peter Feldman

[57] ABSTRACT

A sectional paint brush in which the sections may be used separately or the brush combined to an assembled width, and the individual sections or assembled brush may be supported within a paint can.

10 Claims, 3 Drawing Figures

SECTIONAL PAINT BRUSH

BACKGROUND OF THE INVENTION

This invention relates to new and useful improvements in paint brushes and more particularly to a novel sectional paint brush. This invention relates to new and useful improvements in paint brushes and the present invention provides a paint brush including a pair of brush sections that may be quickly and readily assembled or disassembled facilitating the brush sections to be conveniently arranged in various widths to be used for different types of work and also used separately.

OBJECTS OF THE INVENTION

One of the primary objects of my invention is to provide a single paint brush embodying detachable brush sections of various widths with novel means for combining or independently utilizing the sections, so that brushes of a desired width can be readily had at a cost equal to a single wide brush.

Another object of my invention, is to provide novel means for forming and combining the brush sections, whereby when the sections are assembled to form a single wide brush.

Another object of may invention is to provide a combination brush embodying a single handle and a plurality of brush sections, with means whereby the handle can be connected to any one brush section or to the brush head when the sections are combined therewith.

Another object of my invention is to provide a brush including a plurality of juxtapositioned heads and novel and improved means for retaining said adjacent heads relative to each other.

A further object of the present invention is to provide a paint brush all parts of which are so designed as to permit the same to be conveniently balanced when in use and which may be employed for painting trim work and other small types of molding as well as for painting large areas such as walls and the like.

A still further object of the present invention is to provide a paint brush that is simple and practical in construction, strong and reliable in use, neat and attractive in appearance, relatively inexpensive to manufacture, and otherwise well adapted for the purposes for which the same is intended.

Other objects and advantages reside in the details of construction and operation as more fully hereinafter described.

SUMMARY OF THE INVENTION

A paint brush comprising a pair of brush sections usable separately, or in combination with each other in parallel side-by-side relation. The brush sections each include a body portion having a top end, vertically extending side wall portions having plane abutting surfaces, with vertically extending front and rear wall portions. A plurality of bristles extend from the bottom of each body portion for applying the paint. Each brush section includes a centrally disposed threaded socket on the top end of each body portion for use when the brush section is used separately, and a threaded socket on the top end of one of the sections centrally disposed with respect to the combined width of the pair of assembled brushes when coupled together.

Separable coupling means is provided and associated with each brush section for detachable connection of each body portion to each other for forming an assembled rectangular brush. The separable coupling means includes an internally threaded opening on each of the adjacent side wall portions, and a corresponding threaded element receivable in each of the threaded openings such that the ends of the bristles are in horizontal alignment and the vertically extending side wall portions are abutting each other.

A removable handle is adapted to be employed with the assembled sections or each section separately. The handle having a threaded shank receivable in each of the centrally disposed sockets on the top end of each body portion such that the user may connect the handle at the center of either section when used separately or in the socket centrally disposed when the brush sections are used in assembled relation. Closure means adapted to be disposed across the open sockets when the assembled brush is in use to prevent paint from entering therein is also provided.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

PREFERRED EMBODIMENT OF THE INVENTION

Figure 1:
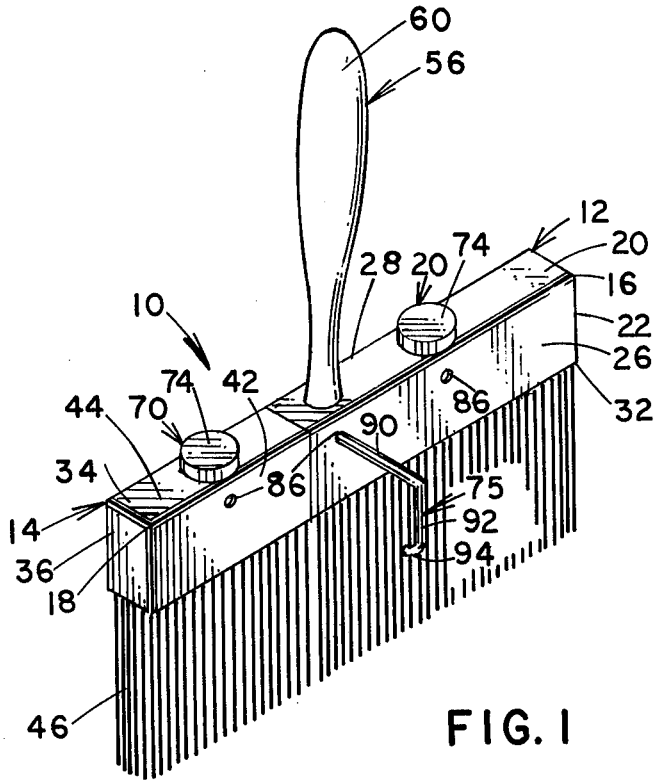
FIG. 1 is a perspective view of a paint brush incorporating the principles of the present invention.
Figure 2:
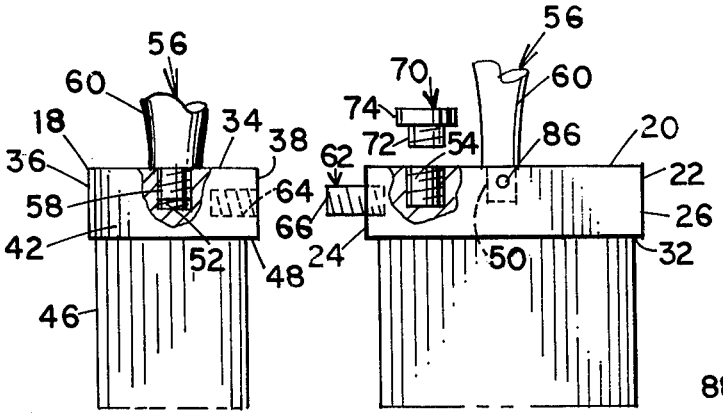
FIG. 2 is a front elevational view of the individual sections of the brush.

Referring now to the drawings, FIGS. 1 and 2 illustrate the sectional brush 10 in its assembled and disassembled relationship. The sectional paint brush 10 includes a pair of brush sections which for purposes of discussion may be referred to as a first brush section 12 and a second brush section 14. The brush sections 12 and 14 may be used separately, or in combination parallel side-by-side relation with each other.

Each brush section 12 and 14 includes a body portion 16 and 18, respectively. The first brush section 12 has a top end 20 with vertically extending side wall portions 22 and 24 in spaced apart relation to each other. Brush section 12 further includes vertically extending front wall portion 26 and rear wall portion 28 in spaced apart relation to each other. A plurality of bristles 30 extend from the bottom wall 32 of the body portion 16.

In a similar manner the brush section 14 having body portion 18 includes a top end 34 with vertically extending side wall portions 36 and 38. The body portion 18 further includes vertically extending front and rear wall portions 42 and 44, respectively. A plurality of bristles 46 extend downwardly from the bottom of 48 of the body portion 18.

In this manner two rectangular brush sections are available for use. Each one may have a different width such that the first section 12 may be four inches wide and the second section 14 may be two inches wide such that combined a six inch paint brush is available. To accommodate the use of the brush section, a centrally disposed threaded socket 50 is contained on the top end 20 of brush section 12 and a threaded socket 52 is contained on the top end 34 of brush section 14. These respective sockets would be spaced along the respective center line of each section such that when a handle is secured therein the brush section may be used in a simple manner.

A threaded socket 54 as seen in FIG. 2 is provided for use when the sections 12 and 14 are assembled. In this manner for brush sections of a 2 inch and 4 inch width the center of socket 54 would be 3 inches from either end.

To facilitate use of the brush sections 12 and 14, a removable handle 56 is provided that is adapted to be employed with the assembled first and sections 12 and 14 or each section separately as seen in FIG. 2. Two handles 56 may be provided to the purchaser of the brush 10. Each handle 56 includes a threaded shank 58 receivable in each of the centrally disposed sockets 50, 52, or 54 and the user may connect the handle 56 at the center of either brush section when used separately. When the brush is assembled then the central socket 54 is used and the contoured upper section 60 gripped by the user in a conventional manner.

To use the brush sections 12 and 14 in assembled relation, separable coupling means 62 associated with each brush section for detachable connection of each body portion 16 and 18 is provided. The separable coupling means 62 includes an internally threaded opening 64 on each of the adjacent side walls 24 and 38 which are adapted to be brought into abutting relationship with each other. To accomplish this a threaded element 66 receivable in each of the threaded openings 64 is provided such that the ends of the bristles 30 and 46 are in horizontal alignment with each other. In this manner the user can rotate the brush sections relative to each other until the coupling means 62 takes the position as seen in FIG. 1 and thereafter removed for individual use of the brush sections. In this manner the threaded element 66 is removed from engagement with either brush section 12 and 14 when they are used separately.

To avoid paint from entering the sockets 50, 52, or 54 which may not be in use, closure means 70 is provided. The closure means 70 is disposed across the open sockets when the assembled brush is in use to prevent paint from entering therein. The closure means 70 includes a threaded portion 72 to mate with the open sockets and a head portion 74 integrally formed with the threaded portion 72 for engaging the top end of the body portion.

Figure 3:
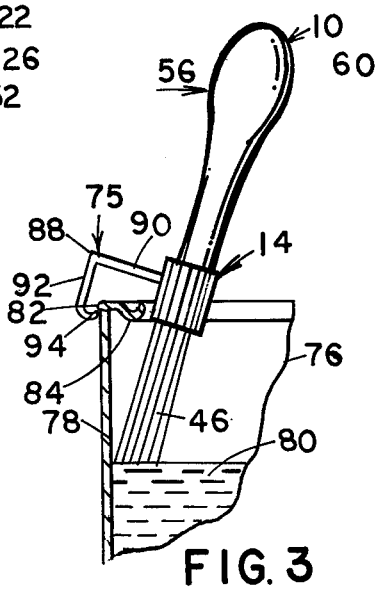
FIG. 3 is a side view, partly in section of the brush supported relative to a paint can.

In order to facilitate the user in resting the brush 10 either in its assembled relationship or the individual sections 12 and 14, supporting means 75 is provided which is particularly seen in use in FIG. 3. The paint can 76 has a vertically extending side wall 78 with paint 80 contained therein and an outer rim 82 having an inwardly extending portion 84 in a conventional manner. The supporting means 75 is adapted to be removably secured to either of the front wall portions 26 or 42 when the sections are used separately or assembled together. The supporting means 75 includes a threaded opening 86 on each front wall and as seen in FIG. 1 the wide brush section 12 has two openings 86 contained on front wall 26 and the narrow brush section 14 has a singular opening 86 contained thereon. Each opening extends centrally and transversely on its respective front wall. The opening 86 is in substantial alignment with the respective sockets for the handle 56.

To obtain the securement a hook 88 is provided which is adapted to grip the rim 82 of the paint can 76 when the brush 10 rests within the can 76. The hook 88 includes an arm portion 90 having threads at one end thereof (not shown), for engagement with threaded openings 86 and an integrally downwardly extending neck portion 92 terminating in an integrally formed inwardly disposed hook portion 94 for engagement with the rim 82 of the paint can 76.

As illustrated above, the present invention provides the user with a great degree of flexibility and the complete brush 10 may be of any desired width and although two brush sections have been illustrated, it is appreciated that more may be employed for use in the invention.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. A paint brush comprising:

a. a pair of brush sections usable separately, or in combination with each other in parallel side-by-side relation, each brush section including:
   i. a body portion having a top end;
   ii. vertically extending side wall portions having plane abutting surfaces;
   iii. vertically extending front and rear wall portions;
   iv. a plurality of bristles extending from the bottom of each body portion;
   v. a centrally disposed threaded socket on the top end of each body portion for use when the brush section is used separately; and
   vi. a threaded socket on the top end of one of the sections centrally disposed with respect to the combined width of the pair of assembled brushes when coupled together, b. separable coupling means associated with each brush section for detachable connection of each body portion to each other for forming an assembled rectangular brush, said separable coupling means including:
   i. an internally threaded opening on each of the adjacent side wall portions; and
   ii. a corresponding threaded element receivable in each of the threaded openings such that the ends of the bristles are in horizontal alignment and the vertically extending side wall portions are abutting each other, c. a removable handle adapted to be employed with the assembled sections or each section separately, said handle having a threaded shank receivable in each of the centrally disposed sockets on the top end of each body portion such that the user may connect the handle at the center of the either brush section when used separately or in the socket centrally disposed when the brush sections are used in assembled relation, d. closure means adapted to be disposed across the open sockets when the assembled brush is in use to prevent paint from entering therein.

2. A brush as defined in claim 1, wherein said closure means includes a threaded portion to mate with the open socket and a head portion integrally formed with the threaded portion for engaging the top end of the body portion.

3. A brush as defined in claim 1, and further including supporting means adapted to be removably secured to the front wall portion of the body portion of each brush section when used separately or when the brush sections are assembled together, said supporting means centrally disposed relative to each brush section and to the assembled brush.

4. A brush as defined in claim 3, wherein said supporting means includes:

a. a threaded opening extending centrally and transversely on each front wall of each section;

b. a threaded opening on the front wall of one of the sections centrally disposed with respect to the combined width of the pair of assembled brushes; and c. a hook threadably secured at one of said threaded openings at one end thereof and the other end adapted to grip the rim of a paint can as the brush rests within the can.

5. A brush as defined in claim 4, wherein said hook includes:

a. an arm portion having threads at one end thereof for engagement with the threaded opening;

b. a downwardly extending neck portion integrally formed with said arm portion; and c. an inwardly disposed hook portion integrally formed with said neck portion for engagement with the rim of the paint can so that the brush is retained in fixed position when not in use.

6. A brush as defined in claim 1, wherein said threaded element is removed from engagement with either brush section when the brush sections are used separately.

7. A brush as defined in claim 1, wherein:

a. said closure means includes a threaded portion to mate with the opening and a head portion integrally formed with the threaded portion for engaging the top end of the body portion; and b. further including supporting means adapted to be removably secured to the front wall portion of the body portion of each brush section when used separately or when the brush sections are assembled together, said supporting means centrally disposed relative to each brush section and to the assembled bursh;

c. said supporting means including:

i. a threaded opening extending centrally and transversely on each front wall of each section, ii. a threaded opening on the front wall of one of the sections centrally disposed with respect to the combined width of the pair of assembled brushes, iii. a hook threadably secured at one of said threaded openings at one end thereof and the other end adapted to grip the rim of a paint can as the brush rests within the can, d. said hook including:

i. an arm portion having threads at one end thereof for engagement with the threaded opeining, ii. a downwardly extending neck portion integrally formed with said arm portion, and iii. an inwardly disposed hook portion integrally formed with said neck portion for engagement with the rim of the paint can so that the brush is retained in fixed position when not in use.

8. A brush as defined in claim 7, wherein said threaded element is removed from engagement with either brush section when the brush sections are used separately.

9. A brush as defined in claim 7, wherein each of the brush sections is of a different width, such that the center of the assembled brush is contained on the wider of the two brush sections.

10. A brush as defined in claim 9, wherein the wider brush section contains two threaded sockets thereon and the narrow brush section one threaded socket thereon.

* * * * *